United States Patent [19]

Gueret

[11] Patent Number: 4,796,647

[45] Date of Patent: Jan. 10, 1989

[54] APPLICATOR UNIT FOR A LIQUID, PASTY OR PULVERULENT PRODUCT

[75] Inventor: Jean-Louis Gueret, Paris, France

[73] Assignee: L'Oreal, Paris, France

[21] Appl. No.: 92,214

[22] Filed: Sep. 2, 1987

[30] Foreign Application Priority Data

Sep. 15, 1986 [FR] France ..... 86 12841

[51] Int. Cl.[4] ..... A45D 40/26

[52] U.S. Cl. ..... 132/320; 401/122

[58] Field of Search .....132/320, 88.5, DIG. 3, 132/85; 401/122

[56] References Cited

U.S. PATENT DOCUMENTS 3,132,653 5/1964 Gazdik ..... 401/122
4,627,454 12/1986 Dahm ..... 132/88.7

FOREIGN PATENT DOCUMENTS 0163323 12/1985 European Pat. Off. ..... 132/88.7
2558833 1/1975 Fed. Rep. of Germany .
1150279 1/1958 France .
1468102 2/1967 France .
2330353 6/1977 France .
2412287 7/1979 France .
2470066 5/1981 France .
2512653 3/1983 France .
2097662 11/1982 United Kingdom .

*Primary Examiner*—Gene Mancene
*Assistant Examiner*—Adriene J. Lepiane
*Attorney, Agent, or Firm*—Cushman, Darby & Cushman

[57] ABSTRACT

The applicator unit for a liquid, pasty or pulverulent product, such as a cosmetic product comprises a bottle provided with a threaded neck and intended to contain the product, a cap closing the bottle by being screwed onto the neck, an applicator disposed at the end of a stem carried by the cap and a wiper device intended to be traversed by the applicator. This wiper device is formed as a first element disposed within the bottle and at the base of the neck, and a second element with a smaller diameter than the first element and extending the lower end of the first element, a first bore within the first element having a wall formed as a spiral with a thread in the opposite direction to the direction of rotation required for unscrewing the cap, a second bore coaxially extending the first bore passing through the end of the second element, the internal wall of the second bore and the external wall of the second element being at least partly covered with a fibrous coating.

10 Claims, 2 Drawing Sheets

APPLICATOR UNIT FOR A LIQUID, PASTY OR PULVERULENT PRODUCT

The present invention relates to an applicator unit for a liquid, pasty or pulverulent product, such as a cosmetic product. It concerns, more particularly but not exclusively an applicator unit for the "eye-liner" type of mascara.

An applicator unit of the above kind traditionally comprises a bottle provided with a threaded neck and intended to contain a cosmetic product, such as mascara, in the case of eye-liner, a cap closing this bottle by screwing onto the neck and applicator disposed at the end of a stem integral with the cap. This applicator unit generally also comprises means for squeezing the applicator and for wiping the lip.

The French Patent Publication FR-A-2470066 relates to an apparatus of the kind, in the neck whereof there is placed a moulded component having lips forming scrapers, disposed one on top of the other, with a triangular cross-section. Such a scraper does not only makes it possible to wipe the stem, but also to squeeze the applicator which, in the case in point, is a brush.

In the same way, the Swiss Patent Publication CH-A-454374 concerns a dispensing applicator for a cosmetic product which comprises a bottle having a neck which narrows to end in a duct wherein the end of an applicator brush slides just with sufficient clearance. The part forming the bottle contains below the above-mentioned duct an element which is made of a semi-elastic substance and which may consist of a stack of washers or of a single part comprising a helical edge. This element is followed, towards the interior of the bottle, by a part made of an elastic substance, comprising a conical inlet leading to an opening having a diameter sufficiently small to allow the hairs of the brush to be smoothed, this smoothing component being followed by another one intended to retain the excess of the product taken along by the stem and the hairs of the brush.

It should be observed that these prior art devices oblige all the users to insert the applicator entirely into the bottle whether the latter is a brush or a pencil brush, in order to recharge it with the product. This has, in particular, the result of depositing more, or less of the dry product in the wiper device and at the same time of soiling the applciator with small fragments of the dry product; this is liable to be the case in particular when the cosmetic product is very viscous.

Moreover, the devices described above can only be used for liquid or viscous products.

This is why one of the objects of the present invention is to provide an applicator unit which can be used both for applying liquid or pasty product, for example cosmetics in particular of the mascara type, and for applying products in powder form.

Another object of the invention is to provide an applicator unit which allows the applicator to be recharged without being completely inserted into the bottle.

An additional object of the present invention is to provide such an applicator unit which allows a continuous delivery of a quantity of the product when the applicator is outside the bottle.

According to the present invention there is provided an applicator unit for a liquid, pasty or pulverulent product such unit comprising a bottle provided with a threaded neck and intended to contain the product, a cap closing the said bottle by being screwed onto said neck, an applicator disposed at the end of a stem carried by said cap, and a wiper device arranged to be traversed by the applicator upon removal of the applicator from the bottle, said wiper device comprising a first portion disposed within the bottle at the base of the neck, and a second portion with a smaller diameter than the first portion and extending the lower end of the said first portion, a first bore within the said first portion having a peripheral wall comprising a spiral having a thread in the opposite direction to the direction of rotation needed to unscrew the cap from the neck, and a second bore extending the first bore coaxially and passing through the end of the second portion, the internal wall of the second bore and the external wall of the second portion being at least partly covered with a fibrous coating.

The thread of the spiral preferably has a cross-section having, in the direction of unscrewing the cap, an edge which is substantially perpendicular to the axis of the first bore and in the direction for screwing the cap down, corresponding to the insertion of the applicator into the bottle, a slanting edge forming an acute angle with the axis of the first bore orientated towards the neck.

According to a preferred embodiment, the bottle comprises a substantially cylindrical reservoir and a wiper carrier which bears on the free edge of the said reservoir and comprises the neck, the first and second portions also being cylindrical, a central aperture being provided in the said wiper carrier at least partly to accommodate the first portion of the wiper device, the said central aperture communicating with the first bore and opening outwardly through said neck.

The central cut-out of the wiper device preferably comprises at the level of the neck, a conical opening for the ready receipt of the stem provided with the applicator.

Preferably the reservoir comprises a means for shaking or homogenising the product which it contains: such a means may, for instance, be constituted by a ball, such as a glass or metal ball.

The applicator advantageously comprises a tip whose surface is covered by a fibrous coating. This coating, as well as the one covering the walls of the second element, may conveniently be deposited by a fibre flocking process.

This tip is preferably frusto-conical and comprises a longitudinal cut-out communicating in its upper portion with a hole arranged in the tip and extending substantially perpendicular to the axis of the latter.

The tip advantageously is formed as the extension of an element allowing the applicator constituted by this tip and this element to be fixed in the stem.

The following description which is not of a restrictive nature, should be read in conjunction with the accompanying drawings.

DETAILED DESCRIPTION OF AN EXEMPLARY EMBODIMENT OF THE INVENTION

Figure 1:
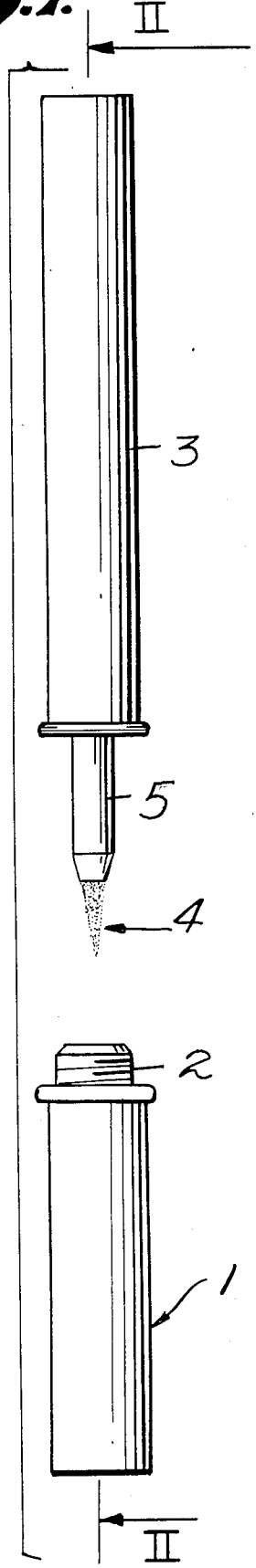
FIG. 1 shows in perspective an applicator unit embodying the present invention, the cap having been detached from the reservoir.

As may be seen in the drawings, an applicator unit comprises a bottle 1 provided with a neck 2 and intended to contain a product, a cap 3 closing this bottle, and an applicator 4 disposed at the end of a hollow stem 5 which forms part of this cap.

The product contained in the bottle 1 can be a liquid, a pasty cosmetic product such as a mascara, or a powder. The neck 2 is so threaded that the cap 3 closes the bottle 1 when screwed thereonto.

The bottle 1 comprises a reservoir 6 which is substantially cylindrical and by a wiper carrier 7 which bears on the free edge of this reservoir and comprises the threaded neck 2.

This wiper carrier 7 comprises a central aperture 8, substantially coaxial with the reservoir 6 and opening outwards via a conical opening 9 to the neck 2. The conical opening 9 facilitates the insertion into the bottle of the applicator 4 carried by the hollow stem 5.

The applicator 4 comprises a tip **4*a* extending from an element 4*b* which is fixedly received in the hollow stem 5**.

This applicator unit also comprises a wiper device intended to be traversed by the tip **4*a* of the applicator 4. This wiper device comprises a first element 10 which is disposed within the bottle 1 at the base of the neck 2, and a second element 11 which has a smaller diameter than the first element 10 and extends the lower end of the first element 10. Within the first element 10 there is arranged a first bore 12 which communicates with the central aperture 8 and whose wall comprises a spiral with a reverse thread direction to the direction of rotation for unscrewing the stopper 3. A second bore 13 extends this first bore 12 coaxially and passes through the end of the second element 11. The internal wall of this second bore 13 and the external wall of the second element 11 are at least partly covered by a fibrous coating 14**.

This fibrous coating is deposited by a flocking process which consists of coating the lower portion of the second element 11 with a monomeric liquid adhesive, either by simple soaking or by spraying the said adhesive by spray gun, then to cause the element 11 thus impregnated to pass into a powder of particles of rayon, nylon or cotton, whose length is comprised between 0.2 and 1.5 mm according to the level of product charging desired. These particles are in suspension in air and are deposited on the impregnated surface of the second element 11 by electrostatic attraction: because of this, in most cases, these particles are orientated substantially perpendicular to the impregnated surface.

Then the second element 11 thus coated is placed into an oven in order to polymerise the monomeric adhesive. After cooling, excess particles are removed by suction.

The tip **4*a* of the applicator 4 comprises a fibrous coating which is deposited by a flocking process identical to that used for coating the lower portion of the second element 11. According to the required use of the applicator, the tip 4*a* will be coated over the whole of its surface or only over a portion of the latter. In this latter case, it may be advantageous to coat only the tapered end of the tip 4*a*** over approximately 3 mm.

The thread of the sprial made in the wall of the first bore 12, has a cross-section having, in the direction of unscrewing the cap 3, an edge which is substantially perpendicular to the axis of the first bore 12 and in the screwing direction of the cap 3 corresponding to the insertion of the applicator 4 into the bottle 1, a slanting edge forming an acute angle with the axis of the first bore orientated towards the neck 2.

The wiper device is at least partly accommodated in the central aperture 8 and is held in position by any suitable means. As shown, the first element 10 comprises at the level of its transition to the second element 11, a re-entrant skirt 15 whose free edge cooperates with a circular groove 16 arranged in the external wall of the wiper carrier 7. The unit thus obtained has a diameter substantially equal to the internal diameter of the reservoir 6. Thus the skirt 15 is tightly held between the external wall of the wiper carrier 7 and the internal wall of the reservoir 6.

Figure 4:
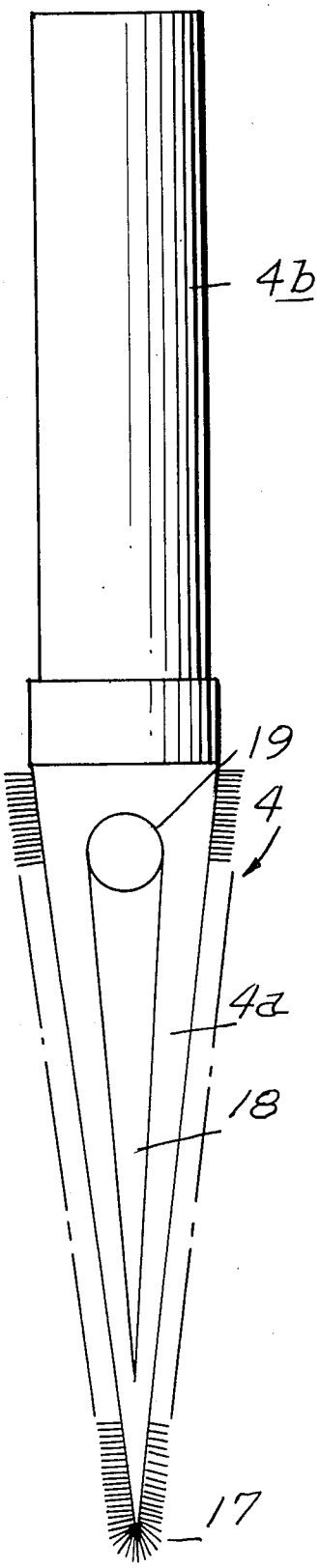
FIG. 4 is a detail view in perspective of the tip of an applicator.

The tip **4*a* of the applicator has a frusto-conical shape, as represented in FIG. 4. The surface of this tip is covered with a fibrous coating 17, identical with that covering the walls of the second element 11** as described above.

The tip **4*a* of the applicator 4 is moulded of a flexible plastic or polymeric material with a polyethylene, polyurethane, polyester, polyvinyl chloride, nitrile or silicone rubber base, or similar. As described above, this tip 4*a*** comprises a fibrous coating, either over only a height of approximately 3 mm at its end or over the whole of its surface.

This tip **4*a* comprises a longitudinal cut-out 18 whose upper portion, that is to say, that nearer the stem 5 to which the tip is fixed, communicates with a hole 19 which is arranged in this tip 4*a*** and is substantially perpendicular to the axis of the latter.

Figure 2:
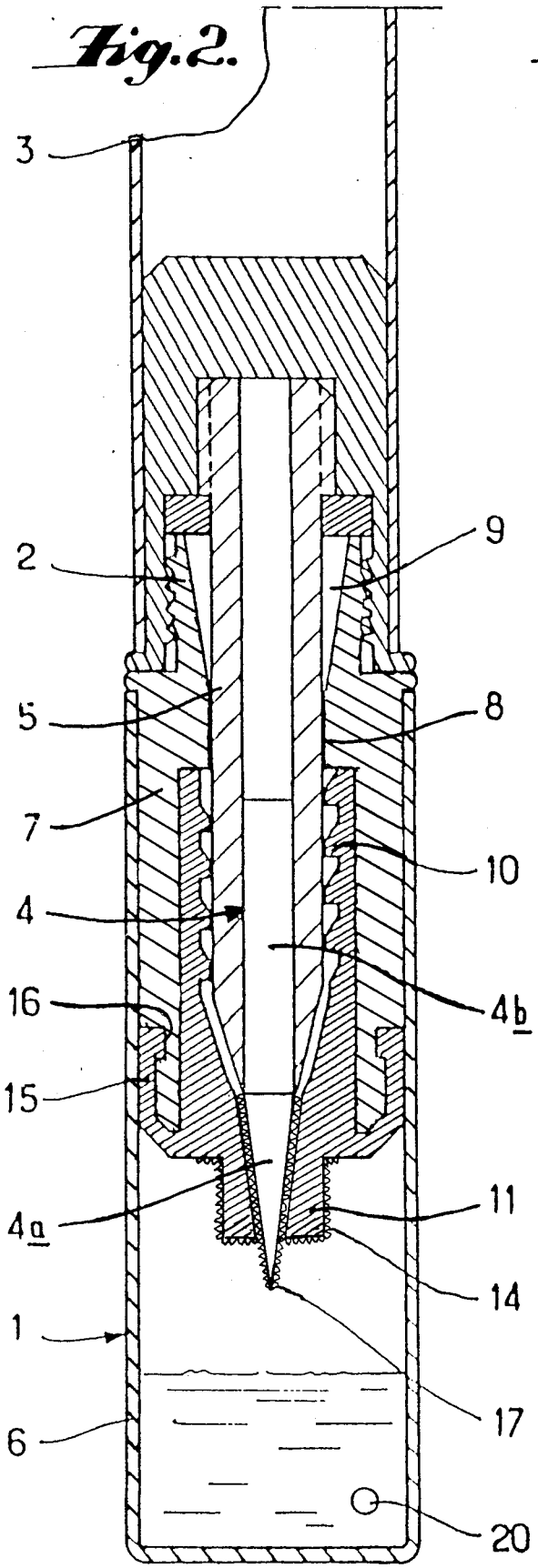
FIG. 2 is a longitudinal cross-section taken along line II—II of FIG. 1, but with the cap shown screwed on the bottle.
Figure 3:
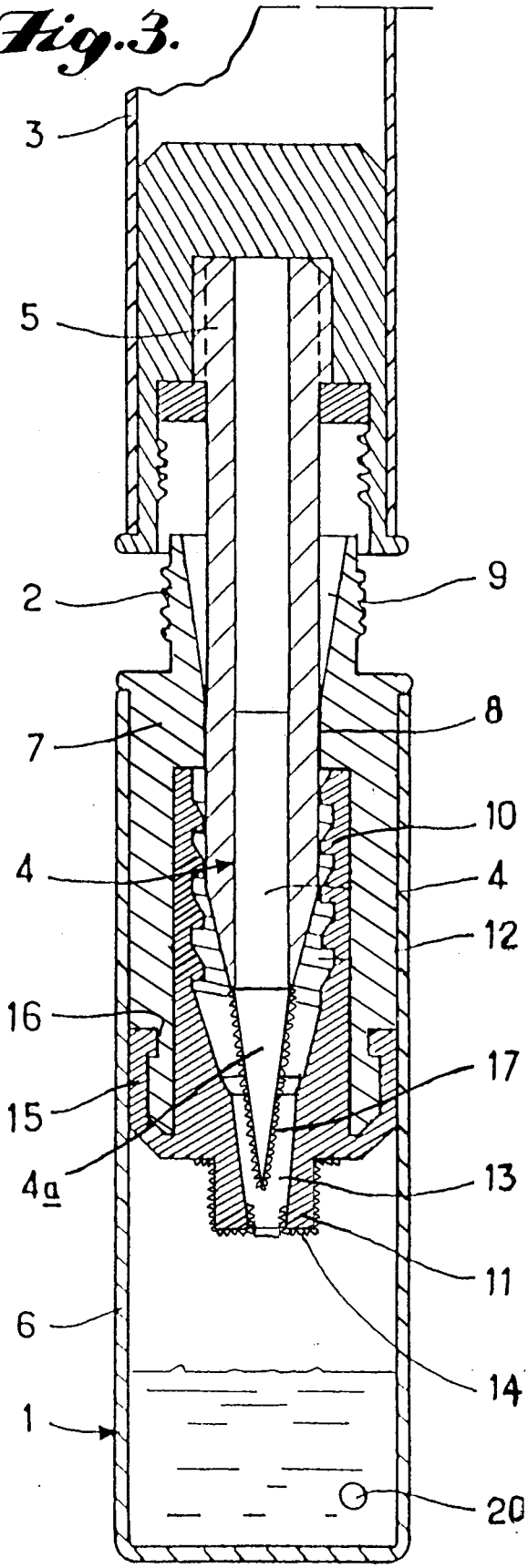
FIG. 3 corresponds to FIG. 2 with the cap just having been unscrewed from the bottle.

When the cap 3 is screwed down on the neck 2 of the bottle 1, as shown in FIG. 2, the tip **4*a* constituting the applicator projects very slightly from the lower end of the second element 11 of the wiper device. By shaking the bottle, one not only impregnates the fibrous coating 17 of the tip 4*a*, but also the fibrous coating 14 of the walls of the second element 11: moreover, by capillarity, the longitudinal cut-out 18 and the hole 19 of the tip 4*a*** are also charged with the product.

By unscrewing the cap 3 and removing it, the excess of the liquid or other material contained in the fibrous coating 17 is retained by the edges of the spiral, because the latter has a profile at right angles in the unscrewing direction: the applicator 4 can thus be used without any risk of solid residues and for a longer time than allowed by the devices known at present, in view of the quantity of the product in reserve in the longitudinal cut-out 18 and the hole 19.

If it is necessary to recharge the fibrous coating of the tip **4*a* with the product, it suffices to insert the latter as far as the level of the lower portion of the second element 11**.

The product retained by the fibrous coating 14 of the walls of this second element 11 can then impregnate the coating 17, of the tip **4*a*** by capillarity. It is therefore no longer necessary to reinsert the applicator completely into the reservoir so as to place this applicator again into contact with the product contained in the reservoir.

Moreover, it will have been noted that only the tip is in contact with the product contained in the reservoir. This prevents the soiling of the stem 5. The seal of the bottle 1 in the closed position is obtained by cooperation between the lower end of the tip 4*a* of the applicator 4 and the internal wall of the second element 11.

To homogenise the product contained in the reservoir 6, it is advantageous for the latter to comprise an agitating device such as a ball 20 made of glass or of metal. This is particularly necessary when the product contained in the reservoir 6 is liable to sedimentation or to separation into several liquid phases.

When the product contained in the reservoir 6 takes the form of a free powder, the charging of the tip 4*a* is effected electrostatically and no longer by way of capillarity as is, moreover, the impregnation of the fibrous coating 14 of the walls of the second element 11.

I claim:

1. An applicator unit for a liquid, pasty or pulverulent product such as a cosmetic product, said unit comprising a bottle adopted to contain the product and provided with a threaded neck, a cap receivable on the said bottle to close the same, there being provided interengaging screwthread means on the said neck and in said cap, a stem carried by said cap, an applicator disposed at the end of said stem, and a wiper device in said bottle adapted to be traversed by the applicator upon insertion of the applicator into and withdrawal of the applicator from the bottle, said wiper device comprising a first portion disposed within the bottle at the base of the neck and a second portion that has a smaller diameter than the first portion and extends from the lower end of the said first portion, a first bore being defined within the said first portion, said first bore having a wall formed as a spiral with a thread in the opposite direction to the direction of rotation required for unscrewing the cap, a second bore being defined in said second portion to extend the first bore coaxially and to pass through the end of the second portion, the second bore having, an internal wall and the second element having an external wall and a fibrous coating at least partly covering said internal and external walls.

2. An applicator unit according to claim 1, wherein the thread of the spiral has a cross-section having, in the direction of unscrewing the cap, an edge substantially perpendicular to the axis of the first bore and, in the direction of screwing the cap down, corresponding to the insertion of the applicator into the bottle, a slanting edge forming an acute angle with the axis of the first bore.

3. An applicator unit according to claim 1, wherein the bottle comprises a substantially cylindrical reservoir and a wiper carrier which bears on the free edge of the said reservoir and comprises the neck, the said first and second portions of the wiper device also being cylindrical, said wiper carrier defining therein a central aperture at least partly to accommodate the first portion of the wiper device the said central aperture communicating with the first bore and opening outwardly through said neck.

4. An applicator unit according to claim 3, wherein the central aperture of the wiper carrier comprises a conical opening through said neck for the ready receipt of the stem provided with the applicator.

5. An applicator unit according to claim 3, wherein the reservoir comprises a member therein for agitation of its contents.

6. An applicator unit according to claim 1, wherein the applicator comprises a tip made of a flexible material and a fibrous coating on said tip.

7. An applicator unit according to claim 6, wherein the fibrous coating is deposited on the surface of the tip by a fibre flocking process.

8. An applicator unit according to claim 6, wherein the tip has a frusto-conical shape.

9. An applicator unit according to claim 6, wherein the tip defines thereon a longitudinal cut-out and a hole arranged in the tip and extending substantially perpendicular to the axis of the tip, said cut-out communicating in its upper portion with said hole.

10. An applicator unit according to claim 6, wherein the applicator comprises an element adapted to be fixed in the stem, said applicator element being formed as an extension of said tip.

* * * * *